US006957525B2

(12) United States Patent
Verstraeten et al.

(10) Patent No.: US 6,957,525 B2
(45) Date of Patent: Oct. 25, 2005

(54) ELECTRICALLY CONDUCTIVE YARN COMPRISING METAL FIBERS

(75) Inventors: Steve Verstraeten, Antwerp (BE); Jan Pavlinec, Frankfurt am Main (DE); Pol Speleers, Waregem (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 10/436,203

(22) Filed: May 13, 2003

(65) Prior Publication Data

US 2003/0209003 A1 Nov. 13, 2003

(30) Foreign Application Priority Data

May 13, 2002 (EP) ..... 02100478

(51) Int. Cl.[7] ..... D02G 3/44

(52) U.S. Cl. ..... 57/238

(58) Field of Search ..... 57/236–238, 243, 57/244

(56) References Cited

U.S. PATENT DOCUMENTS

| | | | | | |
|---|---|---|---|---|---|
| 4,676,058 | A * | 6/1987 | Foley et al. | 57/218 |
| 4,689,444 | A * | 8/1987 | Burgess | 174/128.1 |
| 4,813,219 | A * | 3/1989 | Rees | 57/3 |
| 5,881,547 | A | 3/1999 | Chiou et al. | |
| 5,890,272 | A * | 4/1999 | Liberman et al. | 29/419.1 |
| 5,927,060 | A * | 7/1999 | Watson | 57/210 |
| 2001/0025475 | A1 | 10/2001 | Ouchi | |
| 2002/0136859 | A1 * | 9/2002 | Fisher et al. | 428/95 |

FOREIGN PATENT DOCUMENTS

| | | | | |
|---|---|---|---|---|
| EP | 0 505 936 | A2 | 9/1992 | |
| EP | 911435 | A2 * | 4/1999 | D02G 3/12 |
| EP | 0 920 982 | A1 | 6/1999 | |
| GB | 1 337 957 | | 11/1997 | |

* cited by examiner

*Primary Examiner*—John J. Calvert
*Assistant Examiner*—Shaun R. Hurley
(74) *Attorney, Agent, or Firm*—Foley & Lardner LLP

(57) ABSTRACT

An electrically conductive yarn comprises stainless steel fibers. The electrically conductive yarn comprises at least one elongated element, which has an outer surface being provided out of metal or metal alloy having a lower specific electrical resistance than the stainless steel fibers.

18 Claims, 1 Drawing Sheet

ELECTRICALLY CONDUCTIVE YARN COMPRISING METAL FIBERS

FIELD OF THE INVENTION

The present invention relates to an electrically conductive yarn comprising metal fibers, and more in particular to an electrically conductive yarn having reduced electrical resistance. The present invention further relates to a method to provide such electrically conductive yarn, comprising metal fibers, with reduced electrical resistance.

BACKGROUND OF THE INVENTION

Electrically conductive yarn comprising or consisting of metal fibers is known in the art. Usually, but not necessarily, the metal fibers are bundle drawn fibers, mostly made out of stainless steel alloy.

The electrically conductive yarn may either comprise metal filaments (being so-called "endlessly long" fibers), or may comprise relatively short fibers, having a length usually between 1 and 20 cm (being so-called staple fibers).

Such electrically conductive yarn, especially stainless steel filament yarns, are known at present to be used as electrical resistance for applications in heatable textiles, such as garments or vehicle seat heating systems.

SUMMARY OF THE INVENTION

An electrically conductive yarn comprising stainless steel fibers as subject of the invention further comprises at least one elongated element next to the stainless steel fibers. The elongated element has an outer surface, which is provided out of metal or metal alloy having a lower specific electrical resistance than the stainless steel fibers.

This elongated element may comprise a core and an outer surface, of which according to the present invention, at least the outer layer is electrically conductive due to the metal or metal alloy out of which it is provided. It is clear that the core may also be provided out of metal or a metal alloy. It is even so that the elongated metal element may comprise a core and an outer layer, out of the same material. In the latter case, a man skilled in the art understands that an elongated element, as a whole being provided out of one metal or metal alloy, is to be understood as an elongated element as subject of the invention.

The outer layer may be provided using different processes, in case the elongated element has not been provided as a whole out of one metal or metal alloy. An outer layer may be provided to a core by dipping, extrusion, sputtering, vapor deposition or any other technique known in the art.

The elongated element may have all kinds of radial cross sections, but preferably, it has a circular or rectangular cross section. The surface of the outer layer is preferably more than 5% of the surface of a radial cross section of the elongated element.

Such cross section preferably has an equivalent diameter of more than 10 $\mu$m, most preferably more than 20 $\mu$m, e.g. more than 50 $\mu$m or even more than 100 $\mu$m. Equivalent diameter is to be understood as the diameter of an imaginary circle, having the same surface as the cross section of the elongated element.

The outer layer of the elongated element is preferably provided out of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations of these. Most preferably however, Cu is used.

The core of the elongated element may be provided out of polymer material or out of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations of these. In case the core is provided out of polymer material, preferably thermoplastic polymer material is used, which is resistant to temperatures above 100° C. Most preferably however, the core is provided out of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations of these. Even more preferred is a core,out of the same material as the outer layer. A man skilled in the art understands that the elongated element may be provided as a whole out of one metal or metal alloy. Specific electrical resistance of the metal outer layer is preferably in the range of 15 to 500 $\Omega*mm^2/km$, most preferably in the range of 15 to 90 $\Omega*mm^2/km$.

An electrically conductive yarn as subject of the invention comprises also stainless steel fibers. These fibers may be present in the electrically conductive yarn as filaments (being so-called "endlessly long" fibers), or may be present as relatively short fibers, having a length usually between 1 and 20 cm (being so-called staple fibers).

The stainless steel alloy out of which the stainless steel fibers are preferably provided include AISI 300-series alloys such as AISI 302, 304, 316 or 316L, or AISI 400-series alloys such as AISI 430. The stainless steel fibers preferably have an equivalent diameter being less than 50 $\mu$m, but having an equivalent diameter being more than 0.5 $\mu$m, most preferably between 1 $\mu$m and 35 $\mu$m. Equivalent diameter of a fiber is to be understood as the diameter of an imaginary circle, having the same surface as the cross section of the fiber. The specified electrical resistance is preferably in the range of 500 to 900 $\Omega*mm^2/km$.

Both the stainless steel fibers (filaments or staple fibers) and the elongated element may be transformed into an electrically conductive yarn as subject of the invention by using different spinning techniques such as core spinning techniques, wrap spinning techniques, dref-spinning techniques, composite spinning techniques or ring spinning techniques. An elongated element and a stainless steel yarn may also be transformed into an electrically conductive yarn as subject of the invention by plying one or more elongated elements and one or more stainless steel yarns using appropriate plying techniques.

It is of importance that the elongated element and the stainless steel fibers are in close contact with each other. Preferably, the elongated element makes contact with stainless steel fibers over substantially the whole length of the elongated element. For substantially each radial section of the electrically conductive yarn as subject of the invention, a contact point between the elongated element and at least one stainless steel fiber is to be found.

Preferably, the dimensions and the number of the elongated element, as well as the number of stainless steel fibers in the yarn is chosen in such a way that the elongated elements represents more than 5 vol % but less than 75 vol % of the electrically conductive yarn.

The elongated element may be present at the outer surface of the electrically conductive yarn, or may be located in the volume of the electrically conductive yarn as subject of the invention, e.g. near the core of the electrically conductive yarn.

An electrically conductive yarn as subject of the invention has a linear electrical resistance which may be kept lower than 395 $\Omega/m$, more preferred lower than 100 $\Omega/m$ or even less than 71 $\Omega/m$. The linear electrical resistance is however preferably more than 0.1 Ω/m, more preferably more than 0.2 Ω/m such as 0.5 Ω/m, 2 Ω/m, 7 Ω/m, 14 Ω/m or 30 Ω/m.

Such electrically conductive yarn are preferably applied in textile applications such as heatable textiles, garments or blankets, or for providing heatable vehicle seat and seat coverings. The electrically conductive yarn can also be used to conduct electrical current and/or signals, e.g. in textile woven or knitted fabrics.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
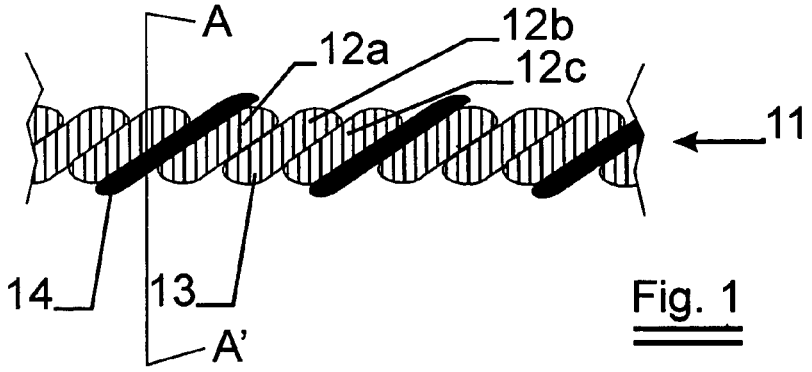
FIG. 1 shows schematically a side view of an electrically conductive yarn as subject of the invention.

A side view of an electrically conductive yarn as subject of the invention is schematically shown in FIG. 1. The electrically conductive yarn 11 comprises single ply yarns 12*a*, 12*b* and 12*c* out of stainless steel fibers 13, the single plied yarns being plied to each other providing a three-ply yarn.

Figure 2:
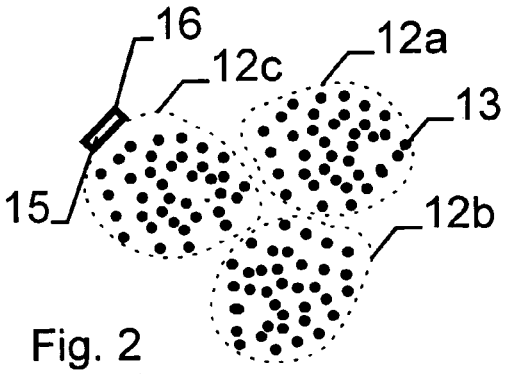
FIGS. 2, 3, 4 and 5 show schematically a radial cross-section of this electrically conductive yarn as subject of the invention.

A radial cross-section according to plane AA' of such electrically conductive yarn is schematically shown in FIG. 2.

The electrically conductive yarn comprises an elongated element 14, which has a core 15 and an outer layer 16. The core 15 being provided out of a polyester, rectangular tape, being coated with a Cu coating providing the outer layer 16.

Figure 3:
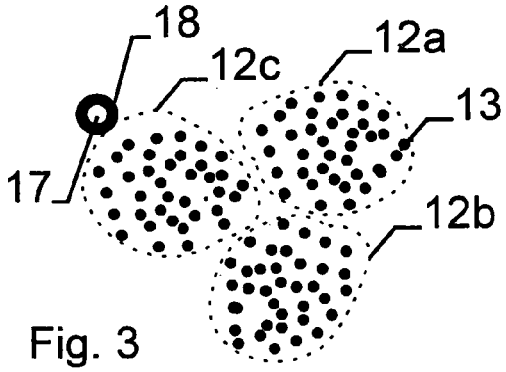

Alternatively, as shown in FIG. 3, an elongated element 14 having a circular cross-section can be provided, e.g. by using a polyamide core 17, coated with a Ag-coating providing the metal outer layer 18.

Figure 4:
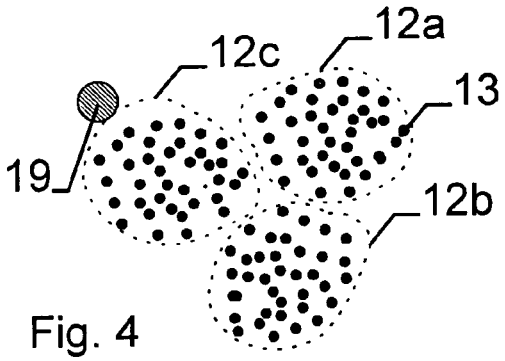

Preferably however, as shown in FIG. 4, a copper wire 19 can be used as an elongated element, having both a core and an outer layer out of metal alloy, being Cu.

As an example, a three-ply electrically conductive yarn comprising three single ply yarns, each comprising 275 filaments with an equivalent diameter of 12 μm, out of AISI 316L alloy, and being twisted using 100 turns per meter in Z direction can be provided. These three single ply yarns are piled together with a Cu-filament of diameter 148 μm.

The electrically conductive yarn so obtained has a linear electrical resistance of 1.2 Ω/m. The stainless steel AISI 316L—fibers have a specific electrical resistance of 983 $\Omega^*mm^2/km$, whereas the Cu outer layer (and core) has a specific electrical resistance of 17 $\Omega^*mm^2/km$.

Over the length of the electrically conductive yarn as subject of the invention, the stainless steel filaments provide 84.6 vol % and the Cu-filament provides 15.4 vol % of the electrically conductive yarn.

The obtained yarn can be used as heating element in a woven or knitted textile fabric, to be used as heatable textile, e.g. to heat car seats or textile fabrics, used to cover such seats.

Figure 5:
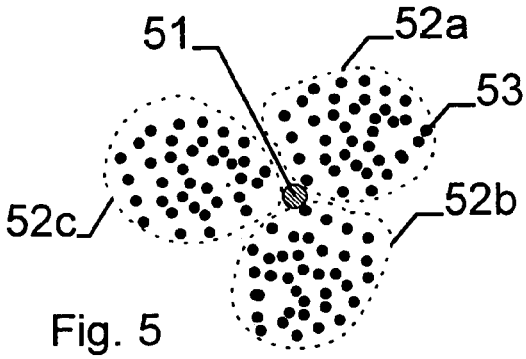

As an alterative embodiment, shown in FIG. 5, the elongated element 51 being an identical copper wire as in the embodiment of FIG. 4, can be present near the core of the multi-ply electrically conductive yarn, comprising 3 single ply yarns 52, each comprising 275 filaments 53 of equivalent diameter 12 μm, out of AISI 316L. The electrical resistance of this embodiment is comparable to the resistance of the embodiment of FIG. 4.

What is claimed is:

1. An electrically conductive yarn comprising stainless steel fibers, wherein said electrically conductive yarn has a linear electrical resistance in the range of 0.1 Ω/m to 395 Ω/m, and characterized in that said electrically conductive yarn comprises at least one elongated element, said elongated element having an outer surface being provided out of metal or metal alloy having a lower specific electrical resistance than said stainless steel fibers, said stainless steel fibers having an equivalent diameter less than 35 μm, said stainless steel fibers having an equivalent diameter more than 0.5 μm.

2. An electrically conductive yarn as in claim 1, said elongated element contacting said stainless steel fibers over substantially the whole length of said elongated element.

3. An electrically conductive yarn as in claim 1, said elongated element representing more than 5 vol % of said electrically conductive yarn, said elongated element representing less than 75 vol % of said electrically conductive yarn.

4. An electrically conductive yarn as in claim 1, said elongated element being provided to said electrically conductive yarn by core spinning operation, wrap spinning operation, ring spinning operation or plying operation.

5. An electrically conductive yarn as in claim 1, said metal or metal alloy being selected out of the group, consisting of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations of these.

6. An electrically conductive yarn as in claim 1, said elongated element further comprising a core, said core being enveloped by said outer surface, said core being provided out of polymer material.

7. An electrically conductive yarn as in claim 1, said elongated element further comprising a core, said core being enveloped by said outer surface, said core being provided out of a metal or metal alloy being selected out of the group, consisting of Cu, Al, Ag, Au, Ni, Ti, W, Zn, Cr, Sn, Cu-alloy, Al-alloy, Ag-alloy, Au-alloy, Ni-alloy, Ti-alloy, W-alloy, Zn-alloy, Cr-alloy, Sn-alloy and combinations of these.

8. An electrically conductive yarn as in claim 7, said core and said outer surface being provided out of the same metal or metal alloy.

9. An electrically conductive yarn as in claim 1, said elongated element being a wire.

10. An electrically conductive yarn as in claim 1, said elongated element having an equivalent diameter being more than 10 μm.

11. An electrically conductive yarn as in claim 1, said stainless steel fibers being stainless steel filaments.

12. An electrically conductive yarn as in claim 1, said stainless steel fibers being staple fibers.

13. The use of an electrically conductive yarn as in claim 1, in heatable textiles.

14. The use of an electrically conductive yarn as in claim 1, for providing heatable vehicle seat or seat coverings.

15. The use of an electrically conductive yarn as in claim 1, for conducting electrical current or electrical signals.

16. An electrically conductive yarn as in claim 1, wherein the electrical resistance of said stainless steel fibers is in the range of 500 $\Omega^*mm^2/km$ to 900 $\Omega^*mm^2/km$.

17. An electrically conductive yarn as claimed in claim 1, wherein the electrical resistance of said outer surface is in the range of 15 $\Omega*mm^2/km$ to 500 $\Omega*mm^2/km$.

18. An electrically conductive yarn, comprising:

stainless steel fibers, wherein the electrical resistance of said stainless steel fibers is in the range of 500 $\Omega*mm^2/km$ to 900 $\Omega*mm^2/km$;

at least one elongated element, said elongated element having an outer surface being provided out of metal or metal alloy having an electrical resistance in the range of 15 $\Omega*mm^2/km$ to 500 $\Omega*mm^2/km$; and wherein the electrically conductive yarn has a linear electrical resistance in the range of 0.1 $\Omega/m$ to 395 $\Omega/m$.

* * * * *